US005657558A

United States Patent [19]

Pohu

[11] Patent Number: 5,657,558

[45] Date of Patent: Aug. 19, 1997

[54] ASSEMBLY SYSTEM ON A SOLE, OF AN EQUIPMENT LINKED TO THE USE OF A SHOE

[76] Inventor: Georges Pohu, 19, rue du Petit Manoir, Villedieu-la-Blouere, France, 49450

[21] Appl. No.: 468,616

[22] Filed: Jun. 6, 1995

Related U.S. Application Data

[63] Continuation of Ser. No. 193,204, filed as PCT/FR92/00790, Aug. 12, 1992, abandoned.

[30] Foreign Application Priority Data

Aug. 14, 1991 [FR] France ..... 91 10426

[51] Int. Cl.[6] ..... A43B 5/00

[52] U.S. Cl. ..... 36/131; 36/136

[58] Field of Search ..... 36/131, 134, 135

[56] References Cited

U.S. PATENT DOCUMENTS

| | | | |
|---|---|---|---|
| 2,640,283 | 6/1953 | McCord | 36/62 |
| 4,298,210 | 11/1981 | Lotteau et al. . | |
| 4,377,042 | 3/1983 | Bauer . | |
| 4,377,952 | 3/1983 | Gamondes . | |
| 4,506,463 | 3/1985 | Chassaing | 36/131 |
| 4,893,420 | 1/1990 | Bezin et al. | 36/131 |
| 4,907,355 | 3/1990 | Allen et al. . | |
| 5,079,968 | 1/1992 | Starner | 36/131 |
| 5,199,192 | 4/1993 | Kilgore et al. | 36/131 |

FOREIGN PATENT DOCUMENTS

| | | | |
|---|---|---|---|
| 0015803 | 9/1980 | European Pat. Off. . | |
| 0193472 | 9/1986 | European Pat. Off. . | |
| 298139 | 1/1989 | European Pat. Off. . | |
| 0424210 | 4/1991 | European Pat. Off. . | |
| 2397319 | 2/1979 | France . | |
| 2464660 | 3/1981 | France . | |
| 2464661 | 3/1981 | France . | |
| 2526748 | 11/1983 | France . | |
| 2532530 | 3/1984 | France | 36/131 |
| 2620412 | 3/1989 | France . | |
| 2620002 | 3/1989 | France . | |
| 2624469 | 6/1989 | France | 36/131 |
| 2240102 | 2/1974 | Germany | 36/131 |

OTHER PUBLICATIONS

English Translation of FR 2,397,319 and DE 2,240,102.
International Search Report and Annex in French.
French Search Report.
International Preliminary Examination Report in French and English.
First Written Opinion, dated Jun. 24, 1993, in French.

*Primary Examiner*—M. D. Patterson
*Attorney, Agent, or Firm*—Greenblum & Bernstein, P.L.C.

[57] ABSTRACT

Assembly system for a sole of a shoe for receiving a piece of equipment adapted for use with the shoe is provided which includes a first assembly element having at least one nest for initially receiving a portion of a piece of equipment, and a second assembly element for positioning and immobilizing the piece of equipment on a sole after the first assembly element receives a portion of the piece of equipment. In the field of cycling shoes, a sole with these features is of a universal type that enables the installation of most existing wedge fastening elements.

22 Claims, 3 Drawing Sheets

ASSEMBLY SYSTEM ON A SOLE, OF AN EQUIPMENT LINKED TO THE USE OF A SHOE

This application is continuation of application Ser. No. 08/193,204, filed Jun. 9, 1994, now abandoned, which is the national stage of International Application PCT/FR92/00790, filed Aug. 12, 1992.

BACKGROUND OF THE INVENTION

1. Field of the Invention

This invention relates, in the field of the shoe as a whole, to a system enabling the assembly on the sole, of pieces of equipment linked to the use of the shoe. The invention, also relates to the pieces of equipment, the shoes, and the soles fitted with the assembly system.

2. Discussion of Background Information

For instance in the field of sport shoes, for cycling, in particular, there exists clips fastened to the sole which enable the connection of the shoes to the pedals. The soles are shaped according to the type of wedge fastening foreseen and the user must thus choose his shoes with respect to available wedge fastening equipment. If the user has several types of wedge fastenings available, he must foresee as many different pairs of shoes.

SUMMARY OF THE INVENTION

The purpose of the invention is to obviate this the above-described short-coming while offering a shoe whose sole is "universal", i.e., able to accommodate various types of clips and/or additional pieces of equipment used as interfaces.

Such a shoe can accommodate other types of equipment according to the field of use such as, for example, spikes for golf shoes or soccer shoes.

According to the invention, the assembly system of an equipment on the sole comprises at least two assembly modes whose first one comprises at least one nest and whose second one, implemented after the first one, is made of positioning and immobilization means of the equipment on the sole.

The use of a nest arranged preferably at the front of the sole enables improvement in the resistance of the assembly in an area where the sole exhibits very small thickness. This nest also advantageously enables quick positioning of the equipment on the sole and creating narrow contact between both elements.

According to a preferred embodiment of the invention, the nest comprises a mortise at the front of the sole pad, and, on the front section of the wedge fastening equipment, a bayonet-shaped lug.

Thus, the equipment can be positioned on the sole, and, at the same time, both parts can be tightened together, which strengthens the assembly and limits tearing or disconnection problems.

Again, according to the invention, the positioning and immobilization means of the wedge fastening equipment on the pad are preferably made of nuts countersunk into the sole's thickness, which co-operate with screws fastened in recesses of the equipment. Other means can be contemplated such as a lock, a latch, and even a clicking or a snapping device.

Again according to the invention, the sole can comprise a recess in the main section of the pad, in order to center and accommodate the equipment. This recess can advantageously comprise lateral openings, arranged on both sides of the pad, which co-operate with ears arranged on the equipment, thus offering some kind of additional longitudinal locking system for the sole's equipment. These lateral openings are also interesting to provide an additional wedge fastening possibility directly on a pedal, using a suitable equipment.

The invention also relates to pieces of equipment fitted with the assembly system.

These parts comprise assembly means made of a bayonet-shaped lug, designed for integration into the sole's mortise, and recesses for the passage of screws, such as in the case of a screw and nut assembly.

According to a first embodiment, the equipment piece comprises a monoblock element fitted with lateral ears provided to fill up the lateral openings of the recess. This piece forms the pad and can be used for walking. It can also accommodate accessories such as cycling wedges that can be connected thereto using fastening screws.

According to another embodiment, the equipment piece comprises a monoblock section, fitted at the level of the sole's lateral openings, with a crosswise groove used for wedge fastening purposes for a cycling shoe.

According to another embodiment, still in the field of cycling shoes, the piece of equipment exhibits two sections. One fixed, fitted with the nesting lug, and the other one, adjustable, comprising a crosswise groove designed for wedge fastening the pedal, located at the level of the sole's lateral openings. The adjustable section advantageously comprises two longitudinal oblong holes which can be positioned onto a hole of the fixed section; while these holes enable the anchoring of both sections on the sole using fastening screws.

According to another embodiment, the cycling equipment section comprises, besides its fastening holes on the sole, longitudinal oblong holes which work together with a mobile metal part arranged between the sole and the equipment and which is used for adjustable anchoring of built-in wedge fastening elements.

According to an additional embodiment, the sole's pad does not exhibit any lateral borders to accommodate a piece of equipment forming the pad properly speaking, the piece comprising, besides the assembly system described above, lateral grooves in order to work with a pedal of the types described in French patents FR-A-2 526 748 and FR-A-2 620 412.

BRIEF DESCRIPTION OF THE DRAWINGS

The invention will be better illustrated, without being limited to the said, by the following description of a special sole embodiment, given only for exemplifying purposes, in connection with different types of pieces of equipment able to be connected to it and represented in the appended drawings, in which.

DETAILED DESCRIPTION OF THE PREFERRED EMBODIMENTS

Figure 1:
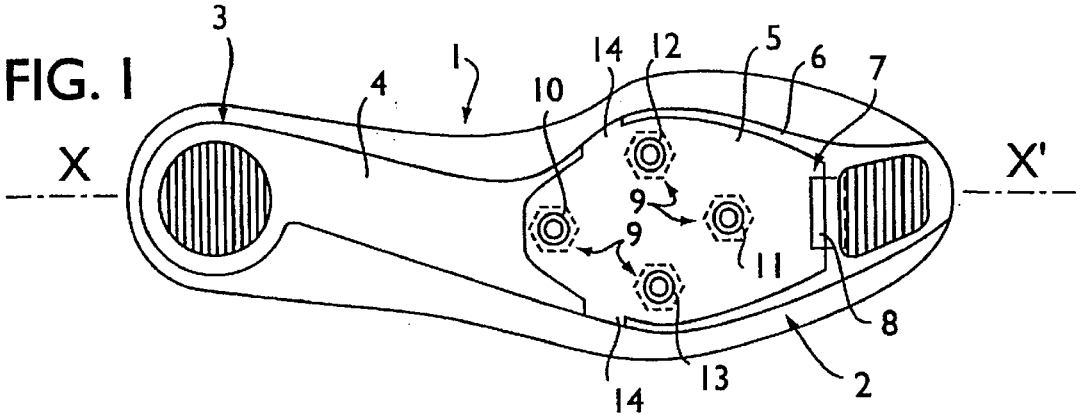
FIG. 1 shows the sole according to the invention with a view seen from underneath.

As represented in FIG. 1, the sole 1 according to the invention is a sole with a classical contour, associated with an upper skin not represented, to form a cycling shoe.

This sole 1 comprises, quite classically, a pad 2 at the level of its front section and a heel 3 at the rear. The pad 2 and the heel 3 are connected by a beam 4 designed to improve its stiffness.

The pad 2 comprises a recess 5, more or less oval in shape, arranged in the thickness of the sole and limited by a peripheral border 6. This recess comprises means to accommodate and position various types of equipment which, in the case of cycling shoes, consist of a toe clip selected according to the desired wedge fastening means, some embodiments of which will be described later.

The assembly system of the various pieces of equipment on the sole comprise a nest 7 arranged at the front end of the recess 5 of the sole and of the pieces. This nest comprises on the sole a mortise 8 which is more or less rectangular in shape, positioned crosswise on the middle axis XX' of the sole, at the level of the border 6. This mortise 8 can go through the sole completely and end on the upper face. On the pieces of equipment, the nest comprises, as detailed further, a shape similar to that of a bayonet.

The assembly system is completed by a set of fastening and immobilization devices 9 of the equipment, implemented after the nest and comprising, for instance, nuts countersunk into the thickness of the sole. A nut 10 is arranged at the level of the rear end of the recess 5, on the side opposite the nest 7. The center part of the pad 2 and of the recess 5 comprises a combination of three nuts 11, 12 and 13, arranged in a triangle. The base of this triangle is defined by linking both nuts 12 and 13; this base has been arranged crosswise to the middle axis XX' of the sole and it is located nearer the heel 3 than is nut 11. The vertex of the triangle is defined by the nut 11 arranged at the front; it is located more or less halfway between the nest 7 and the line linking the nuts 12 and 13, the line being more or less halfway between the nuts 10 and 11.

Moreover, the recess 5 comprises two side openings 14 arranged in the border 6 and positioned just behind the nuts 12 and 13. These openings 14 are used for certain types of equipment in connection with wedge fastening means provided in the thickness of the sole, FIG. 3.

FIGS. 2 to 12 show different types of wedge fastening equipment, without being limited to those illustrated for positioning and locking in the recess 5. These pieces of equipment constitute the wedge fastening and/or anchoring means properly speaking onto the pedal; they exhibit dimensions suited to the recess 5.

The various pieces of equipment comprise an engagement means of the nest 7 made of a bayonet-shaped lug 15, arranged at their front end. This lug is designed for embedding into the mortise 8 of the sole and locking in position therein. Various hole-shaped recesses are provided equally and suitably on these pieces of equipment to complete the fastening on the sole; this attachment is performed via screws working together with the countersunk nuts 10, 11, 12, 13, or a portion of the nuts.

Figure 2:
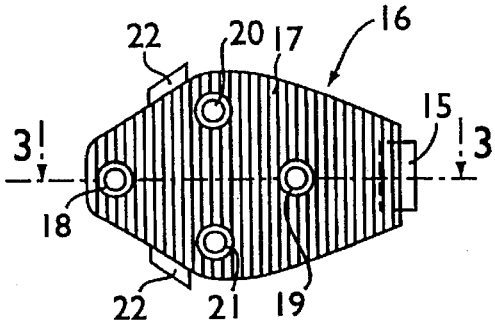
FIG. 2 shows a possible embodiment of a piece of equipment designed to be adapted to the sole's pad, seen from underneath.
Figure 3:
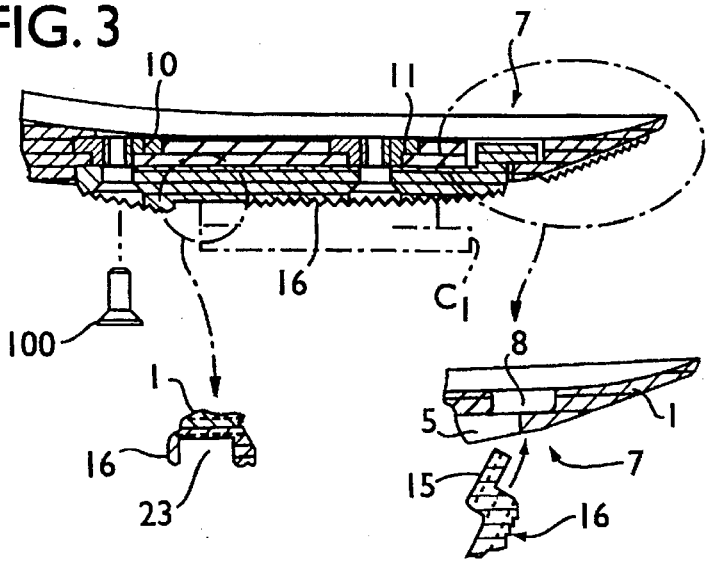
FIG. 3 is an enlarged section according to 3—3, of the piece of FIG. 2, mounted on the sole of FIG. 1.

FIGS. 2 and 3 show a first possible embodiment of this piece of equipment. This piece 16 is obtained by molding a PVC-type plastic material. It is more or less oval in shape and may comprise open cells on the top to reduce the weight of the piece. Its lower portion comprises a set of transverse streaks 17 or spikes or grooves, designed to facilitate contact with the ground or the positioning of wedge fastening elements. The lug 15 is centered on the extreme forward end and four holes 18, 19, 20, 21 are provided over its surface, each matching one of the countersunk nuts 10, 11, 12, 13 of the sole. The piece 16 also comprises two lateral ears 22 designed for embedding into the lateral openings 14 arranged in the border 6 of the recess 5.

Positioning the piece of equipment 16 into the recess 5 is carried out by incorporating the front lug 15 into the mortise 8 of the sole. Toggling the piece to the bottom of the recess 5 causes the front section of the lug 15 to be blocked in the mortise 8 (FIG. 3). The piece 16 is hugged against the bottom of the recess 5 and its assembly on the sole 1 is completed by fastening screws 100 located in the holes 18, 19, 20, 21 and the nuts 10, 11, 12, 13 respectively. The ears 22 are integrated into the lateral openings 14. The thickness of the piece 16 is such that it enables filling up the recess 5 of the sole; it serves as a pad.

This type of piece allows levelling the lower face of the sole; the shoe so fitted enables its user to walk normally. Moreover, the assembly screws provided evenly on its surface may allow fastening at least one wedge fastener C1, as represented in thin mixed lines in FIG. 3. The wedge fastening element thus built protrudes from the lower face of the sole 1. These wedge fastening elements can be of all types and they advantageously use the three center holes 19, 20 and 21 of the intermediate piece 16 and the three nuts 11, 12 and 13 of the sole to fasten them.

According to another embodiment represented in the frame located on the left side of FIG. 3, the piece 16 comprises a transversal groove 23. The width of this groove 23 corresponds to those of the lateral openings 14 arranged in the border 6 of the sole 1; it is used as a direct positioning and wedge fastening means of the sole on the pedal. The piece of equipment 16 is then used as such, without any additional wedge fastening accessory.

Figure 4:
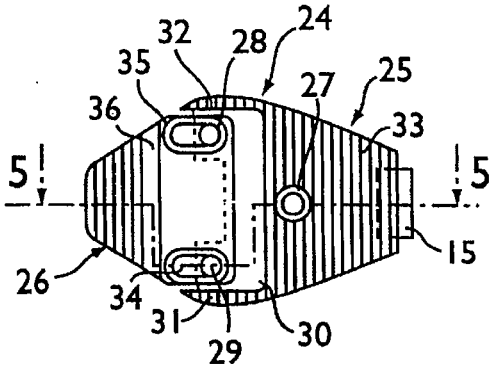
FIG. 4 shows another embodiment of the piece of equipment, in two sections, seen from underneath.
Figure 5:
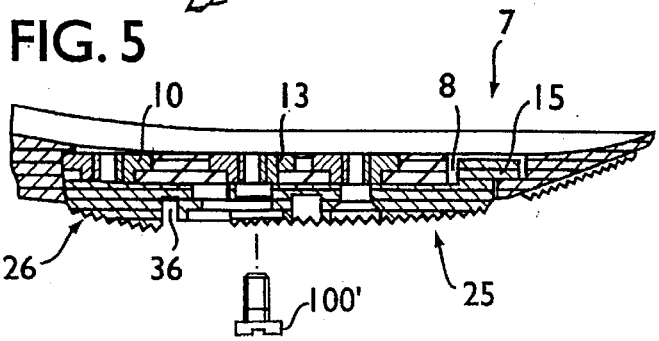
FIG. 5 is an enlarged section according to 5—5 of the piece in two sections of FIG. 4, mounted on the sole.

FIGS. 4 and 5 show another type of piece of equipment liable to be integrated to the recess 5 of the sole. This part 24 is made of two sections: a front one 25 and rear one 26.

The front section 25 comprises the lug 15 at its front section and comprises three assembly holes 27, 28 and 29 matching the nuts 11, 12 and 13 respectively of the sole. The hole 27 is located more or less on the middle axis of the body of the part 25; both holes 28 and 29 are arranged laterally, in a recess 30 open to the rear and closed laterally by rims 31 and 32. The lower face of the part 25, designed for contacting the ground, advantageously comprises a set of transversal grooves 33. The part 25 should lock onto the front section of the recess 5 via the lug 15 and a fastening screw integrated to the front hole 27, matching the nut 11. The part 25 is fixed and fills up only a section of the recess 5; the lateral rims 31 and 32 stop before the lateral openings 14 of the sole. The rear section 26 of the piece of equipment 24 is designed for partial integration into the recess 30 of the front counterpart 25. This rear section 26 shows a requirement smaller than the non-filled space of the recess 5. It comprises two longitudinal oblong holes 34 and 35 and, on the rear, a transversal groove 36. The oblong holes 34 and 35 are designed for correct positioning on the holes 28 and 29 of the front section 25 and on the nuts 12 and 13 of the sole. Fastening screws 100' enable assembling the various sections amongst themselves; the oblong holes 34 and 35 enable adjusting the position of the part 26 in the recess 5. This position adjustment can be made from the front to the rear and also at an angle with respect to the middle axis XX'; the transversal groove 36 used for wedge fastening the shoe on the pedal can thus be positioned practically without any restrictions according to the user's choice. In all cases, this transversal groove 36 matches the lateral openings 14 arranged in the sole. There is thus a wedge fastening part integrated to the sole which allows the user to walk normally. As regards this embodiment, it can be noticed that the nut 10 located at the rear end of the recess 5 is unused.

Figure 7:
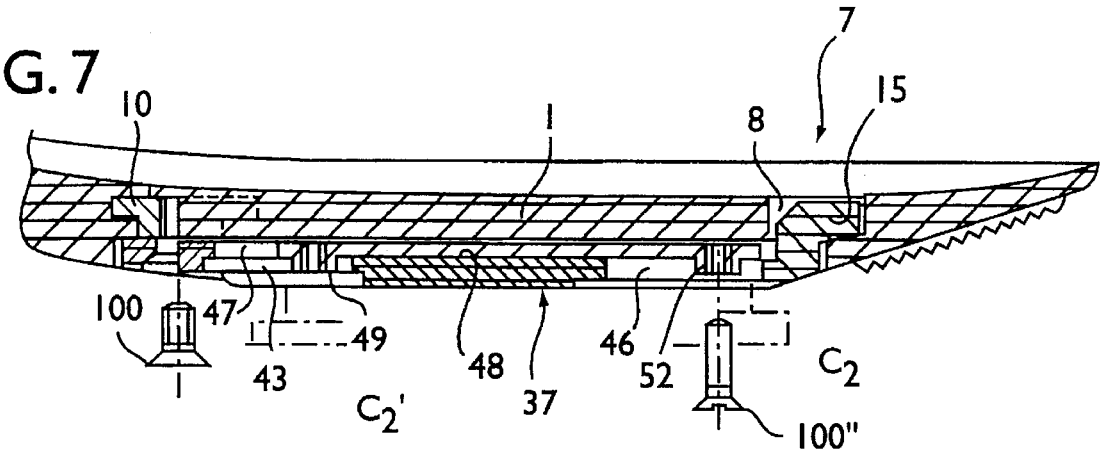
FIG. 7 is a section according to 7—7 of the piece of equipment of FIG. 6, mounted on the sole.
Figure 6:
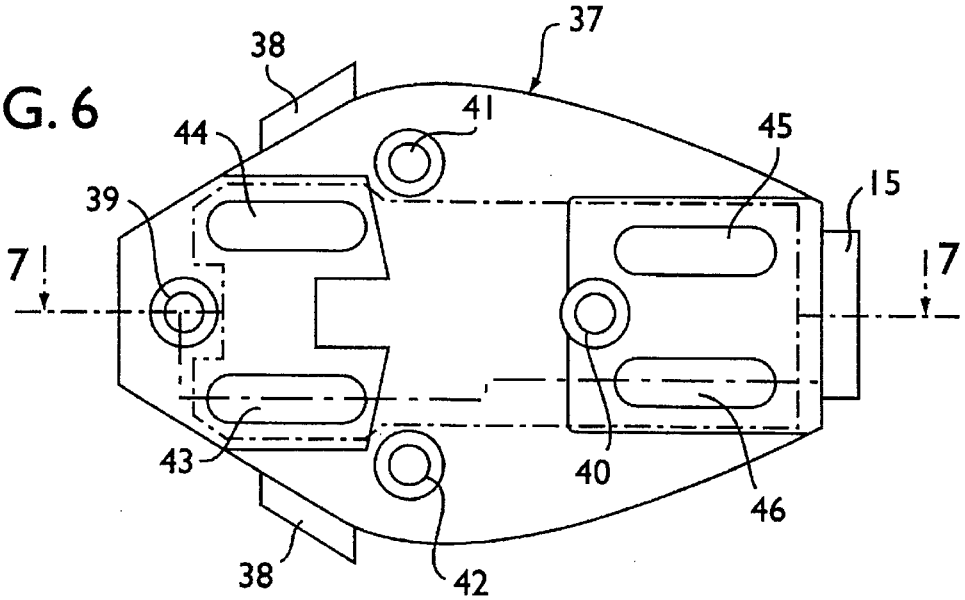
FIG. 6 is a plane view of another possible embodiment of the piece of equipment, seen from underneath.
Figure 8:
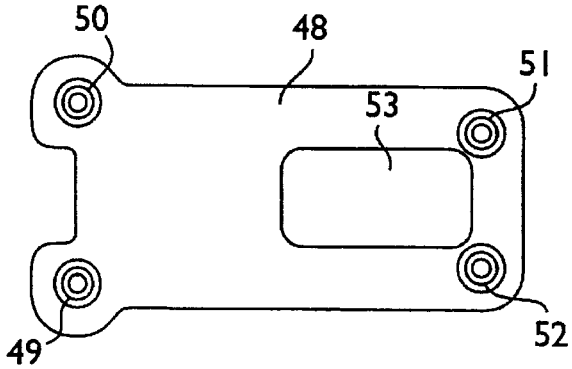
FIG. 8 shows the metal piece integrated into the equipment represented on FIG. 6.

FIGS. 6 to 8 show another possible embodiment of the piece of equipment.

The overall shape and the sizes of this piece of equipment 37 correspond to those of piece 16 of FIG. 2. It has been enlarged in FIG. 6 to show the structural details better.

The body of the piece 37 is extended to the front by the lug 15 of the nest and it comprises, on the sides, two ears 38 designed for embedding into the openings 14 arranged in the border or rim 6 of the sole. The piece of equipment 37 is designed to fill up the recess 5 completely. It comprises four assembly holes 39, 40, 41 and 42 arranged respectively to match the nuts 10, 12, 13 and 11 of the sole, for the passage of fastening screws 100. The piece of equipment 37 also comprises four longitudinal oblong holes 43, 44, 45 and 46 arranged on lines which are parallel to each other. These oblong holes end with a recess 47 arranged on the upper face of the piece 37 and whose contour is represented in dotted lines, FIG. 6. This recess 47 is designed for receiving a sliding metal plate 48 arranged between the bottom of the recess 5 of the sole 1 and the piece of equipment 37. This metal plate 48, represented in FIG. 8, comprises four threaded holes 49, 50, 51 and 52, arranged for positioning opposite the oblong holes 43, 44, 45 and 46 of the piece 37. The couples of holes 43–49, 44–50, 45–51 and 46–52 enable fastening wedge accessories C2, C'2, attached using anchoring screws 100". The wedge accessories C2, C'2, represented in thin mixed lines protrude under the sole, from the piece of equipment 37; their position can be adjusted as required over the length of the oblong holes 43 to 46. An opening 53 has been arranged in the center section of the plate 48, at the level of the assembly hole 41, to allow the plate 48 to slide in the recess 47.

Figure 9:
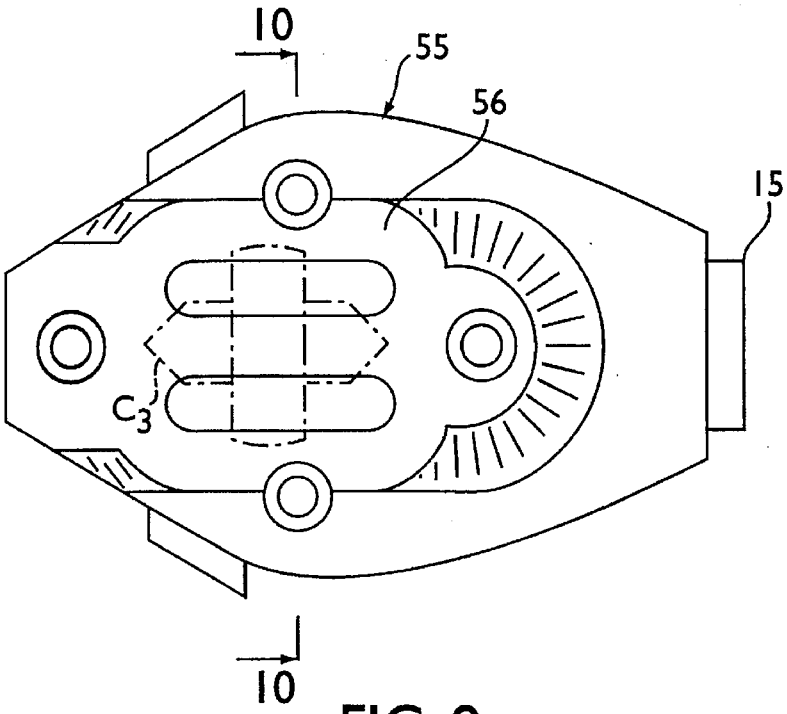
FIG. 9 is a plane view of another piece of equipment, seen from underneath.
Figure 10:
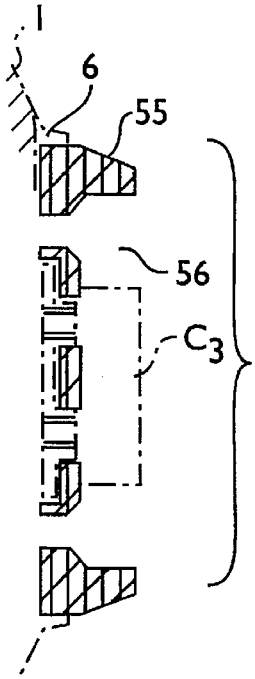
FIG. 10 is a section according to 10—10 of FIG. 9.

FIGS. 9 and 10 show a piece of equipment 55 of the same type as that described previously in relation to FIGS. 6 to 8. However, the wedge accessory C3 is different because it is integrated to a recess 56 arranged on the lower face. The depth of the recess 56 is at least equal to the height of the accessory C3 so that the user can walk normally, bearing on the piece of equipment 55 used as a pad.

Figure 11:
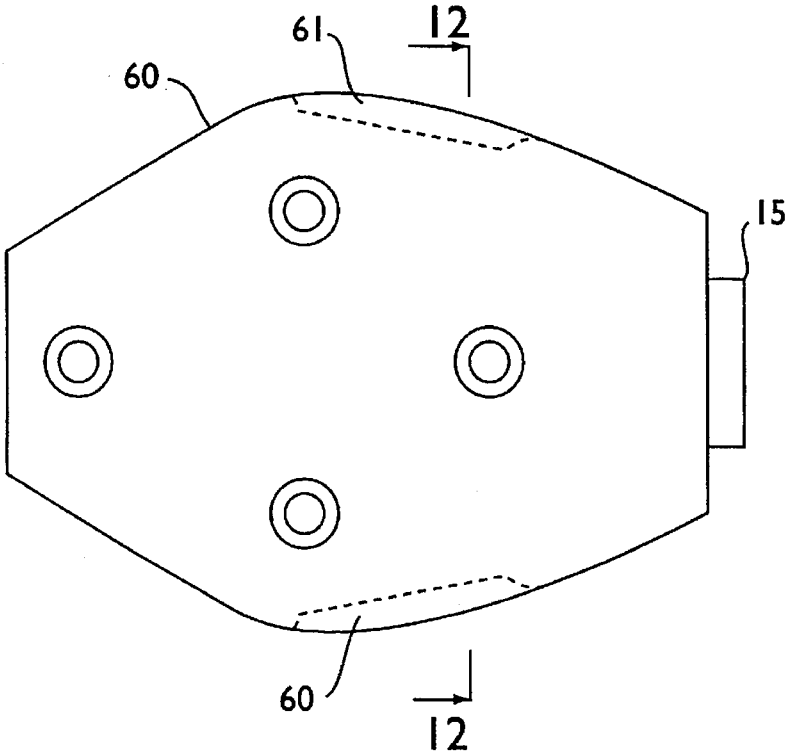
FIG. 11 is a plane view of a piece of equipment working together with a pedal fitted with rails.
Figure 12:
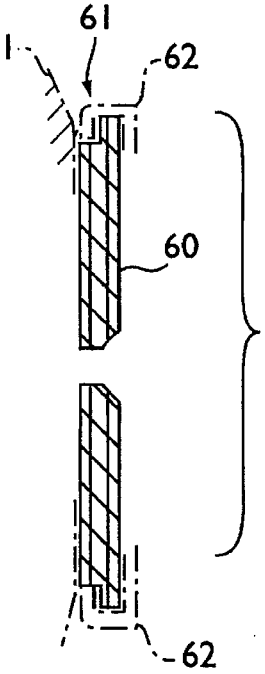
FIG. 12 is a section according to 12—12 of FIG. 11.

FIGS. 11 and 12 show another piece of equipment 60 suited to a sole 1 provided without the rim 6, at least on the front section of the pad.

This piece of equipment 60 is accommodated in the recess 5 and is used as a pad. It also comprises lateral grooves 61 arranged as hollow sections against the sole 1 and used as recesses for rails 62 represented in thin mixed lines in FIG. 12. These rails 62 are part of a fastening device for shoes on pedals detailed in French patents FR-A-2 526 748 and FR-A-2 620 412.

The various embodiments of pieces of equipment described above are not exhaustive and it is quite possible to contemplate other types of parts used either directly as wedge accessories or for anchoring built-in wedge fastening means.

The structure of the means described above is particularly suited to cycling shoes, but other fields of application can also be contemplated (golf, soccer, etc.) for which the wedge means will be replaced with spikes etc. In all cases, the shoe can be suited as required according to the wedge accessory, or equivalent, as desired. The shoe thus shows a universal character since it can accommodate various wedge fastening means or equivalent; it also enables quick, easy and efficient modification of the wedge structure.

The shoe fitted with such a universal sole can advantageously be suggested in conjunction with a selection of at least two different pieces of wedging equipment. The user can thus install the equipment matching the equipment available; he does not need to change the whole shoe when he uses a different material.

I claim:

1. A sport shoe comprising:

a sole having a longitudinal axis and a transverse axis, a forefoot pad region and a heel pad region;

a recess in said forefoot pad region having a shape;

an element having a shape similar to said shape of said recess;

a mortise formed in said recess, aligned with said transverse axis;

engagement means provided on said element, for insertion through and engagement with said mortise; and fastening means, provided in said recess, for fastening a wedge fastening piece through said element;

wherein upon insertion of said engagement means through said mortise, said element is received within said recess and said mortise engages with and immobilizes said element in directions along both said longitudinal axis and said transverse axis.

2. The sport shoe according to claim 1, wherein said engagement means comprises a bayonet-shaped lug extending from said element.

3. The sport shoe according to claim 1, wherein said mortise is formed at a front end of said recess, said front end of said recess being defined as the end closest to an end of said sole designed to support the toe region of a foot.

4. The sport shoe according to claim 3, wherein said engagement means comprises a bayonet-shaped lug extending from a front end of said element, wherein said front end of said element is received within said front end of said recess.

5. The sport shoe according to claim 3, wherein said fastening means comprise a plurality of nuts embedded within said sole, wherein one of said nuts is located near a rear end of said recess opposite said front end, and three of said nuts are arranged in a triangular pattern between said nut located near a rear end of said recess and said mortise, one of said three nuts forming a vertex of said triangular pattern pointing forwardly toward said mortise.

6. The sport shoe according to claim 5, wherein said sole further comprises a pair of lateral openings extending laterally from opposite lateral borders of said recess, said lateral openings being positioned between said triangular pattern and said nut located near a rear end of said recess.

7. The sport shoe according to claim 6, wherein each of said pair of lateral openings has a depth substantially equal to a depth of said recess.

8. The sport shoe according to claim 6, wherein said element further comprises:

a monoblock having a pair of ears dimensioned to nest within said pair of lateral openings.

9. The sport shoe according to claim 5, wherein said element further comprises:

means for cooperating with said fastening means, for fastening said wedge fastening piece therethrough, said means for cooperating comprising at least one hole-shaped recess for positioning at least one screw therethrough to mate with at least one of said nuts.

10. The sport shoe according to claim 5, wherein said element further comprises:

first and second blocks, said first block comprising said engagement means and being fixedly placed within a front portion of said recess, said second block being adjustably positioned within a rear portion of said recess;

means for cooperating with said fastening means, for fastening said wedge fastening piece therethrough, said means for cooperating comprising at least one hole-shaped recess through said first block, for positioning at least one screw therethrough to mate with at least one of said nuts, and at least one longitudinal oblong opening through said second block, for adjustably positioning said second block with respect to at least one of said nuts and for positioning at least one screw therethrough; and said second block further comprises a transverse groove which functions as a wedge fastening means for fastening said sport shoe to a bicycle pedal.

11. The sport shoe according to claim 3, wherein said element further comprises:

means for cooperating with said fastening means, for fastening said wedge fastening piece therethrough; and wherein said element is dimensioned to be snugly received in said recess without play.

12. The sport shoe according to claim 11, further comprising:

longitudinal oblong openings recessed on a side of said element which interfaces with said recess when said element is placed in said recess; and a movable plate adjustably anchored to said element through said longitudinal oblong openings.

13. The sport shoe according to claim 12, wherein said movable plate comprises a metallic plate.

14. The sport shoe according to claim 11, wherein said element further comprises:

lateral grooves which form rail recesses for fastening to rails on a bicycle pedal, when said element is placed in said recess.

15. The sport shoe according to claim 11, wherein said element further comprises:

an accessory recess on a lower face thereof, for integrally receiving a wedge fastening piece.

16. The sport shoe according to claim 1, wherein said recess is substantially oval-shaped and said element is substantially oval-shaped.

17. The sport shoe according to claim 1, wherein said element comprises a thickness substantially equal to a depth of said recess, wherein said element, when received within said recess, is substantially flush with said sole and acts in concert with said sole for walking upon.

18. The sport shoe according to claim 1, wherein said fastening means comprise a plurality of nuts embedded within said sole.

19. The sport shoe according to claim 1, wherein said sole further comprises lateral openings extending from said recess, said lateral openings each having a depth substantially equal to a depth of said recess.

20. The sport shoe according to claim 19, wherein said element further comprises:

a monoblock having ears dimensioned to nest within said lateral openings.

21. The sport shoe according to claim 1, wherein said element further comprises:

first and second blocks, said first block comprising said engagement means and being fixedly placed within a front portion of said recess, said second block being adjustably positioned within a rear portion of said recess.

22. The sport shoe according to claim 21, wherein said second block comprises:

a transverse groove which aligns with said lateral openings when said element is positioned within said recess;

wherein said transverse groove functions as a wedge fastening means for fastening said sport shoe to a bicycle pedal.

* * * * *